US011338359B2

(12) United States Patent
Reikher et al.

(10) Patent No.: US 11,338,359 B2
(45) Date of Patent: May 24, 2022

(54) COMPOSITE PART WITH EXTERNAL PART CAST AROUND INTERNAL INSERT AND METHOD FOR PRODUCING THE SAME

(71) Applicant: Aludyne North America LLC, Southfield, MI (US)

(72) Inventors: Alexandre Reikher, Pleasanton, CA (US); Sam A. Kassoumeh, Canton, MI (US)

(73) Assignee: Aludyne North America LLC, Southfield, MI (US)

( * ) Notice: Subject to any disclaimer, the term of this patent is extended or adjusted under 35 U.S.C. 154(b) by 0 days.

(21) Appl. No.: 16/482,110

(22) PCT Filed: Feb. 9, 2018

(86) PCT No.: PCT/US2018/017614

§ 371 (c)(1),
(2) Date: Jul. 30, 2019

(87) PCT Pub. No.: WO2018/148538

PCT Pub. Date: Aug. 16, 2018

(65) Prior Publication Data

US 2019/0344336 A1 Nov. 14, 2019

Related U.S. Application Data

(60) Provisional application No. 62/457,443, filed on Feb. 10, 2017.

(51) Int. Cl.
*B22D 19/00* (2006.01)
*B22D 17/00* (2006.01)

(52) U.S. Cl.
CPC ..... *B22D 19/0081* (2013.01); *B22D 17/00* (2013.01)

(58) Field of Classification Search
CPC ..... B22D 17/00; B22D 17/24; B22D 19/00; B22D 19/0081; B22D 19/04; B22D 19/16; B32B 3/02
(Continued)

(56) References Cited

U.S. PATENT DOCUMENTS 5,263,530 A 11/1993 Colvin
2013/0101780 A1 4/2013 Hanna
(Continued)

FOREIGN PATENT DOCUMENTS

JP 07-139419 A 5/1995

OTHER PUBLICATIONS

International Search Report and Written Opinion issued for PCT/US2018/017614 dated May 25, 2018.
(Continued)

*Primary Examiner* — Kevin P Kerns
(74) *Attorney, Agent, or Firm* — Harness, Dickey & Pierce, P.L.C.; Stephen T. Olson

(57) ABSTRACT

Composite parts (100) and methods of making the same are disclosed. A composite part may include an internal insert component (124) made of a first material. The internal insert component may be provided with surface features such as mechanical surface features or material surface features, on at least a portion of its surface. The composite part may further include an external part component (136) that is cast around at least a portion of the internal insert component, and is made of a second material different from the first material. The surface features of the internal insert component may help establish a bond within the composite part between the internal insert component and the external part component.

19 Claims, 12 Drawing Sheets

(58) Field of Classification Search
USPC ..... 164/98, 100, 101, 111, 112; 428/600
See application file for complete search history.

(56) References Cited

U.S. PATENT DOCUMENTS

| | | | |
|---|---|---|---|
| 2016/0159392 | A1 | 6/2016 | Hoffmann |
| 2016/0175923 | A1 | 6/2016 | Liu |

OTHER PUBLICATIONS

A. Dunn et al; Laser surface texturing for high friction contacts; Published by Elsevier B.V.; Oct. 1, 2015.
O. Dezellus et al.; Mechanical testing of titanium/aluminium-silicon interface: Effect of T6 heat treatment; journal ISSN : 0921-5093; (2 pages).
Oliver Dezellus et al.; Mechanical testing of titanium / aluminium-silicon interfaces by push-out; HAL-archives-ouvertes.fr; HAL Id: hal-00283654; May 30, 2008; 15 pages.
PCT International Preliminary Report on Patentability dated Jan. 29, 2019.

(a) Structured/deterministic Surface Texture (b) Random Surface Texture

COMPOSITE PART WITH EXTERNAL PART CAST AROUND INTERNAL INSERT AND METHOD FOR PRODUCING THE SAME

CROSS-REFERENCE TO RELATED APPLICATIONS

This application claims priority to U.S. Provisional Patent Application Ser. No. 62/457,443, filed on Feb. 10, 2017, the contents of which are hereby expressly incorporated by reference in their entirety.

FIELD

The present disclosure relates to composite parts and, more particularly, to composite parts having a high strength internal insert component and a die cast external part component.

BACKGROUND

Composite parts employing different materials may advantageously provide a blend of material properties. For example, a first material may provide relative strength or durability, while a second material different from the first may provide light weight or other desirable characteristics.

Composite parts are often difficult to assemble or form due to differing material properties of the multiple materials used. Merely as one example, one material may have a different coefficient of thermal expansion than another, and as a result the two materials may respond differently during any hot forming technique (e.g., casting) or cooldown from the same. More specifically, the different rates of thermal expansion may result in cracks, dislocations, gaps, or the like between the different materials. As a result, a bond between the different materials may be weakened or otherwise negatively affected.

Accordingly, there is a need for a composite part that addresses the above shortcomings.

DRAWINGS

Figure 13A:
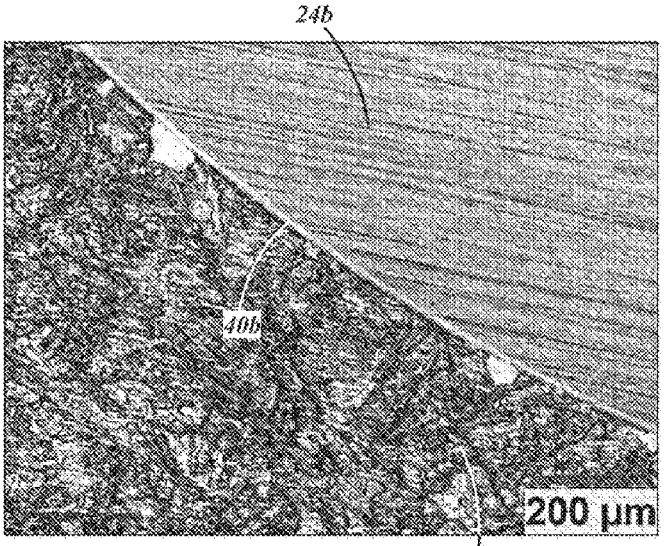
Figure 13B:
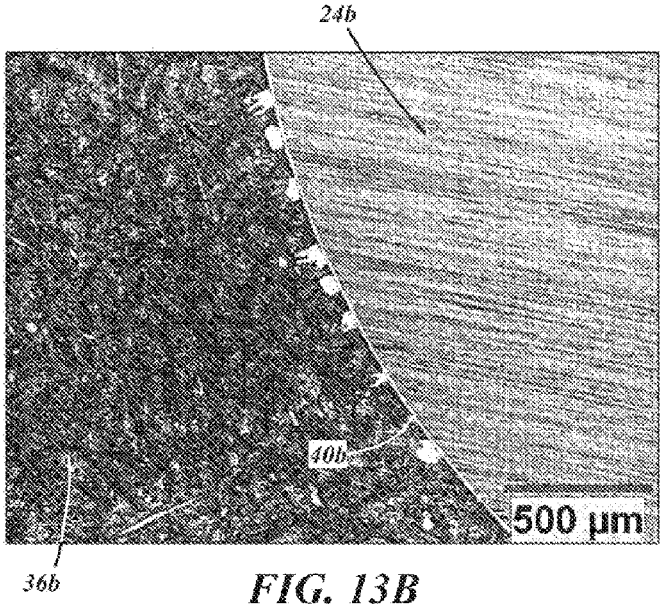
Figure 14A:
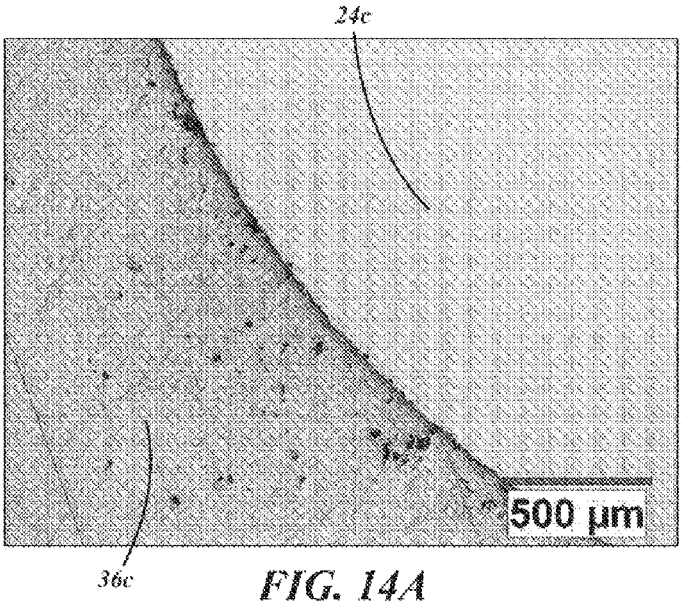
Figure 14B:
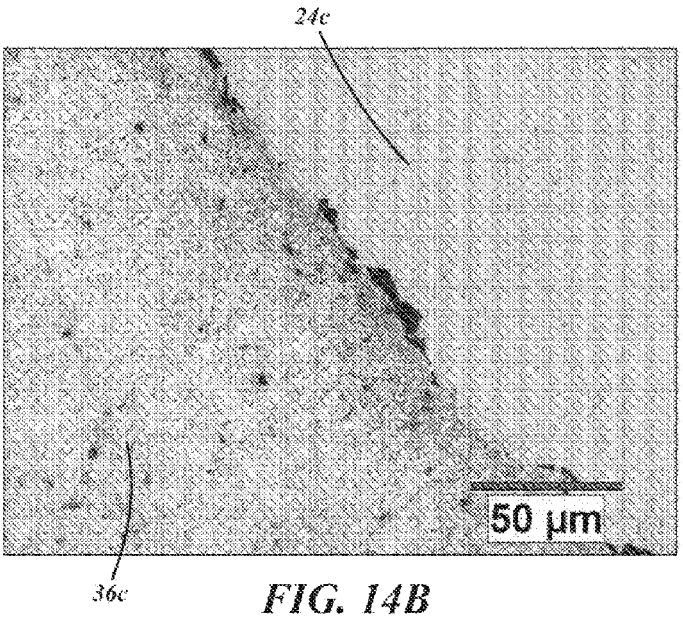

FIGS. 13A and 13B are enlarged views of a cross-section of an interface region between a tube-shaped internal insert component formed of a titanium-based material, and an external part component formed of an aluminum-based material; and FIGS. 14A and 14B are enlarged views of a cross-section of an internal insert component formed of a stainless steel material, which has a shell coating layer formed of an aluminum-based material applied about the internal insert component.

DESCRIPTION

Exemplary illustrations are provided herein of a composite part having an internal insert component and an external part component, where the external part is cast and solidified around the internal insert during a die casting operation, as well as methods and equipment for forming the same. The composite part is suitable for any number of applications, particularly those that seek to improve the strength of lightweight metallic parts. The terms "internal insert component," "internal insert," "insert component" and "insert" are used interchangeably in the present application, as are the terms "external part component," "external part," "part component," "cast part," "metallic part," etc.

According to a non-limiting example, a composite part includes an internal insert component that is made of a titanium-based material and includes surface features formed on at least a portion of its surface, and an external part component that is made of an aluminum-based material or zinc-based material and is cast around the insert. An interface region may be formed between the internal insert component and the external part component. Additionally, as will be discussed further below, the surface features may help establish a bond within the composite part between the internal insert component and the external part component.

According to another non-limiting example, a potential method for producing the composite part includes the steps of: positioning the internal insert component that includes an outer surface with surface features formed on at least a portion thereof within a casting die, and casting a molten material around the internal insert component. The method may further include solidifying the molten material to form the external part component, with the surface features helping to establish a bond within the composite part between the internal insert component and the external part component.

One or more surfaces of the internal insert component may be provided with surface features that generally enhance a bond between the internal insert component and the external part component. Merely as examples, surface features may include surface discontinuities or undulations such as scoring, scratches, stipples, pits, peaks, grooves and/or other features that prevent the surface from being smooth. The surface features may increase the surface area of the internal insert component that is presented to the external part component material when cast about the internal insert component. Such surface features may facilitate enhanced bonding between the internal insert component and external part component by creating a variety of interface angles that are presented to the molten external part material that is being cast about the internal insert component, creating a mechanical interlock in addition to any metallurgical interlock or bonding between the components. For example, the increased surface area between the internal insert component and external part component may generally mitigate losses in bond strength resulting from any gaps between the components. In other words, the increased surface area results in a higher proportion of directly joined material to the gaps (if any) that form between the internal insert component and external part component as the external part component is cast under pressure and solidifies around the internal insert component. Accordingly, larger contact area between the internal insert component and the external part component may improve mechanical bond strength between the internal insert component and the external part component.

An interface region between the internal insert component and external part component may be relatively thick compared to composite parts where surface features are not formed on the internal insert component, potentially resulting in a relatively thick intermediate material layer. For example, where an aluminum-based material is used for the external part component and a titanium-based material is used for the internal insert component, a relatively thick layer of titanium aluminide (TiAl) or other intermetallics (for example, $Al_3Ti$) may be formed through the interface region. The interface region may be impacted in thickness by the size and/or dimensions of the surface features created in the internal insert component prior to casting the external part component around the internal insert component. According to one example, the interface region includes intermetallic compounds of titanium and aluminum and is between 1 μm and 5 mm thick, inclusive, depending on the embodiment. For instance, embodiments of the interface region that do not include mechanical surface features or coating layers on the internal insert component may be towards the lower end of this thickness range (e.g., 1 μm to 50 μm thick, inclusive); embodiments of the interface region where the internal insert component includes mechanical surface features or coating layers, but not both, may be more in the middle of this thickness range (e.g., 10 μm to 1 mm thick, inclusive), whereas embodiments of the interface region where the internal insert component includes both mechanical surface features and coating layers may be more on the upper end of this thickness range (e.g., 50 μm to 5 mm thick, inclusive).

Surface features are thought to improve bonding between the internal insert component and external part component, which may be of particular importance where the internal insert component is expected to impart material properties and other characteristics to the resulting composite part. Merely as an example, titanium is a relatively high-strength metal and may be depended upon to carry a significant portion of a load on a composite part where the external part component is formed from aluminum. Accordingly, surface features that facilitate bonding between the internal insert component and external part component may enhance the degree to which a titanium internal insert component increases the strength of a composite part.

Moreover, surface features may be selectively provided about an internal insert component, i.e., in specific location(s) of the part. For example, surface features may be provided only on certain portions of the internal insert component, such as where a bonding strength enhanced by surface features may be of particular importance. In other examples, different types of surface features may be provided in different areas of an internal insert component, thereby allowing enhanced bonding strength or improved material properties to be provided in a targeted manner about the internal insert component. Additionally, a selective approach may facilitate cost reductions, such as by applying coatings or forming surface features only to the extent necessary, thereby reducing production and/or material costs associated with the coatings and/or surface features.

In other examples, surface features may include a shell or coating layer that is formed around an internal insert component prior to casting of the external part material. The shell or coating layer may include the same material as the external part component, a material similar to the external part component, or a material designed to facilitate bonding between the internal and external components, to name a few possibilities. The shell or coating layer may be a relatively thin layer of material that is deposited on the surface of the internal insert component, e.g., by a spraying method such as cold metal spraying. During casting of the molten external part material about the internal insert, the shell layer may enhance bonding between the internal insert component and external part component by presenting a metallurgically compatible surface in the interface region to which the molten external part material can bond. Additionally, a method of applying a shell layer such as high-speed spraying may result in a greater contact area between the shell layer and the internal insert component, as compared with examples where an external part component is cast directly upon an internal insert component. It is also possible for the internal insert component to use surface features, as well as a shell or coating layer, as the two approaches are not mutually exclusive and in fact may advantageously employed together, as will be described further below.

Composite Part

It should be appreciated that the composite parts, methods and equipment described herein may be used in a wide variety of applications and industries. One particularly suitable application for such composite parts is the automotive industry, where lightweight parts are oftentimes needed to support vehicle structures or otherwise carry significant loads. Non-limiting examples of vehicle structural parts that could include or otherwise utilize the composite parts described herein include frame members, cross members, car cross beams, instrument panel (IP) supports, steering knuckles, suspension components, control arms, engine cradles, connecting nodes, as well as any other vehicle or non-vehicle structural part where it is desirable to replace heavier metals like iron or steel with lighter metals like aluminum.

Figure 1:
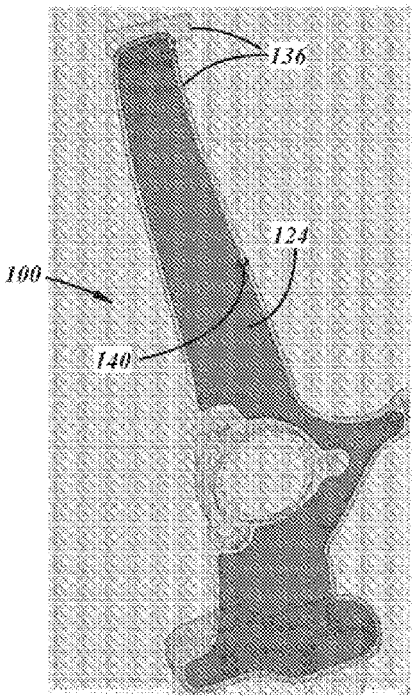
FIG. 1 is a perspective view of an example of a composite part having an internal insert component and an external part component.

With reference to FIG. 1, there is shown an example of a composite part in the form of a support member 100, which may be used as steering knuckle. The knuckle 100 includes at least one internal insert component 124, as well as an external part component 136 that is cast or otherwise formed around the internal insert component.

The internal insert component 124 and external part component 136 may be formed from similar or different materials. For example, the internal insert component 124 may be formed from a titanium-based material, whereas the external part component 136 may be formed from an aluminum-based material and have a wall thickness of 6 mm or greater. In a different example, both the internal insert component 124 and external part component 136 are made from aluminum-based materials, perhaps the same aluminum alloy or different aluminum alloys. Different combinations of materials in a single part 100 in this manner may facilitate part characteristics more ideally matched or tailored to a given application. For example, the knuckle 100 is relatively lightweight owing to the use of an aluminum-based material in the external part component 136, but also has substantial strength compared with solid aluminum parts because of a titanium-based material that makes up the internal insert component 124. Moreover, a bond strength between the internal insert component 124 and external part component 136 may be increased with the use of surface features formed on an outer surface of the internal insert component 124 prior to casting the molten external part material around it. This process may result in an interface region 140 formed between at least a portion of the internal insert component 124 and the external part component 136. Other material combinations may alternatively be employed. In the example shown in FIG. 1, the insert component 124 is relatively large compared to the part component 136 (i.e., most of the interior of the overall part 100 is attributed to the insert component 124 and the part component 136 appears more as a coating layer or skin). This is not necessary, however, as the part component 136 could be substantially large than the insert component 124 in other embodiments.

As used herein, the term "aluminum-based material" broadly means any material where aluminum is the single largest constituent by weight and may include pure aluminum, as well as aluminum alloys. Merely by way of example, potential aluminum-based materials may include aluminum A380 alloy, A360 alloy, Aural-2 alloy, or ADC12 alloy, to cite just a few possibilities. As used herein, the term "titanium-based material" broadly means any material where titanium is the single largest constituent by weight and may include pure titanium as well as titanium alloys. Merely by way of example, some potential titanium-based materials may include titanium alloys that, in addition to titanium, contain some combination of aluminum, iron, nickel and/or vanadium, such as Titanium grade 5 (Ti-6Al-4V).

The internal insert component 124 may have surface features formed thereon that are configured to improve bonding, whether it be mechanical, metallurgical and/or other bonding, between the internal insert 124 and external part 136. The surface features may be formed in any number of suitable ways, including laser etching, texturing or ablation with the use of pulsed lasers. Mechanical operations such as mechanical etching, scoring, scratching, grinding, scraping or sand blasting, or machining operations such as milling, turning, or vibro-mechanical texturing, may also be used. Additionally, other operations such as electrical discharge machining (EDM), plasma, or any other method that is convenient for forming surface discontinuities or undulations on an insert surface may be employed.

In some examples, laser ablation may be particularly advantageous as a method for forming mechanical surface features, due to a relatively high precision, repeatability and relatively lower cost associated with laser ablation compared with other approaches. As a result, laser ablation may lend itself particularly well with respect to commercial applications of example processes described herein. Chemical etching may similarly lend itself well, especially on parts with relatively flat or planar surfaces, but may be relatively more difficult to implement for more complex part shapes, geometry, and/or greater depths of the surface features desired.

While previous approaches to using laser ablation and chemical etching were typically directed to cleaning surfaces, example processes disclosed herein for forming mechanical surface features typically result in material removal to create desired mechanical surface features. Accordingly, in examples employing laser ablation or chemical etching disclosed herein, the processes may be significantly more aggressive in removing material to create the surface features. This material removal or texturing of an outer surface of an insert component forms mechanical surface features in certain examples as preparation for bonding a cast material to the surface, and is distinguished from previous approaches where the end goal is merely cleaning the outer surface, removing an oxidation layer, etc.

The surface features may have a relatively small depth, for example, an average depth of between 5 μm and 100 μm, inclusive. In another non-limiting example, surface features include a patterned or random texturing on the surface of the insert where the individual elements of the texturing are, on average, between 10 μm and 20 μm deep and 50 μm and 80 μm wide, inclusive. A raw surface profile may include an uneven or jagged appearance in section, thereby presenting a bonding surface having an irregular configuration that promotes a mechanical interlock upon casting of the molten external part material about the internal insert. The surface features can be applied over the entire outer surface of the internal surface component 124 in a generally homogeneous or uniform manner, or they can be selectively applied to certain areas or portions of the insert where improved bonding strength is needed.

Mechanical surface features may further enhance bonding between a molten external part component and an internal insert component to an extent the mechanical surface features provide surfaces that are perpendicular or nearly so with respect to forces and stresses applied on the completed part. For example, mechanical surface features, as will be described further below, may establish undulations in the surface such that various peaks and valleys in the surface contour are formed (at least on the scale of the relatively small surface features discussed herein). The peaks and valleys may increase the bond strength between an internal insert and an external part component (and therefore the overall strength of the finished composite part) to the extent they create reaction surfaces that are perpendicular, or nearly so, with respect to subsequent part stresses.

In tensile tests of an exemplary part sample, an interface between an external part component formed of an aluminum-based material and an internal insert formed of a titanium-based material extends in a direction generally parallel to a longitudinal axis of the sample (i.e., in the direction of tension). In this manner, undulations in the surface of the internal insert, such as peaks and valleys, extend at least partially perpendicular to the tensile forces imparted upon the sample. The bond between the external part component and internal insert component of the sample remained intact during tensile testing of the sample, and the titanium-based internal insert rod broke (at approximately 517 megapascals or 75,000 pounds-per-square-inch), while the bond between the titanium-based material and aluminum-based material remained intact, indicating that the interface between the two different materials relatively strong when considered in the text of the overall part.

It is also possible for the internal insert component 124 to be coated with particles (e.g., macro- or micro-particles) to improve material characteristics within the knuckle 100, and/or to enhance bonding between the internal insert component 124 and external part component 136. For example, before the molten material of the external part 136 is cast around the internal insert 124, different types of particles can be applied to at least a portion of the outer surface of the internal insert so as to create a particle-rich shell or layer. Examples of particle application techniques include hot fusion, cold spraying, high velocity spraying, electrodeposition, or application of the particles as the insert is being formed (e.g., during a process of casting or otherwise forming the insert itself), to cite a few possibilities. Of course, any suitable technique for applying particles to an outside surface of the internal insert may be employed. Some non-limiting examples of suitable particles include: ceramic-based particles, graphite-based particles, diamond-based particles, magnesium-based particles (e.g., MgO or $MgAl_2O_4$), aluminum-based particles (e.g., particles of pure aluminum, aluminum oxide ($Al_2O_3$) or aluminum titanium ($Al_3Ti$)), silicon-based particles (e.g., particles of pure silicon, silicon oxide ($SiO_2$) or silicon carbide SiC)), titanium-based particles (e.g., particles of pure titanium, titanium oxide ($TiO_2$), titanium boride ($TiB_2$)), and nickel-based particles (e.g., pure nickel or nickel aluminum (NiAl)), as well as particles containing chromium, copper, zinc, silver, gold, and various alloys, oxides, carbides, nitrides, hydrides and/or borides thereof. In some examples, the particles are less than 1.0 mm in diameter on average, and in some cases even smaller than that, such as less than 0.25 mm in terms of an average diameter or dimension. In other examples, the particles are micro particles where the average diameter or dimension is less than about 100 μm. Carbon black, fullerenes and carbon nanotubes may also be used, as may any suitable intermetallic compounds.

Upon introducing the molten material of the external part component 136 into a casting die where the internal insert component 124 is positioned, the molten material contacts, envelops and heats the surface of the insert component. Depending on the temperature of the molten material and the melting points of the internal insert component material, the heat associated with the molten material may melt at least an outer layer or portion of the internal insert component 124. The melted outer layer of the internal insert component 124 may then mix with the nearby molten material of the external part component 136 to help form the interface region 140 located between the two components; an intermetallic layer may also be formed at the interface region 140. The mixing, solidifying and eventual bonding between these materials may be enhanced by the surface features present on the outer surface of the internal insert component 124, for example, by presenting an increased surface area to the molten material for melting and bonding. For those examples where particles have been applied to an outer surface of the internal insert component 124, the particles may initially intermix with the nearby molten materials, however, such materials usually quickly cool and solidify so as to trap or capture the particles within a particle-rich section of the interface region 140. Such a section can influence the properties and/or characteristics of the interface region.

Of course, the methods, equipment and composite parts described herein are not so limited, as they are merely provided as examples. In view of the wide range of applications to which exemplary parts and methods may be directed, the description that follows is directed to relatively simplified part shapes to facilitate explanation of the concepts.

Tooling System

As noted above, the composite parts described herein may be formed in a casting process, where an external part component is generally cast around an internal insert component. Referring now to FIGS. 2 and 3A-3D, one example of a tooling system is illustrated, which may be used for forming a composite part and/or using any example methods described herein, such as a high pressure die cast process.

The tooling system 200 may include a mold for casting parts, e.g., in a high pressure die cast process. The tooling 200 comprises a moveable/ejector half 202 and a stationary half 204. The stationary half 204 may remain fixed, e.g., with respect to a support surface (not shown in FIG. 2), while the ejector half 202 may move, for example to facilitate removal of parts formed within the tooling 200, service/repair of the tooling 200, etc.

The ejector half 202 and stationary half 204 have an ejector half cavity block 206 and stationary half cavity block 208, respectively, which cooperate to define a mold for forming one or more composite parts. The ejector half cavity block 206 and stationary half cavity block 208 are supported by an ejector holder block 210 and a stationary holder block 212, respectively.

Molten material (not shown in FIG. 2) may be injected into a mold cavity 236 defined by the ejector half cavity block 206 and stationary half cavity block 208 by way of a sleeve 216. For example, molten material may be poured into a pour hole 220, and forced into the mold cavity 236 by a plunger 218, as will be described further below. The molten material may then enter the mold cavity 236 by way of a runner 222, which extends from an end of the sleeve 216 to the mold cavity 236.

As will be described further below, an internal insert component 224 may be positioned within the mold cavity 236 so that molten material can be cast around it. For example, one or more locating pins 226 may be used to position and maintain the internal insert component 224 within the mold cavity 236. Upon being positioned within the mold cavity 236, molten material may be cast about the internal insert component 224.

One or more cooling channels 228 may be provided adjacent the mold cavity to facilitate management of a mold temperature and/or cooling of molten material within the mold cavity 236. Moreover, as will be described further below, in some examples cooling passages or other features may be incorporated into or located adjacent the locating pins 226. The locating pins 226 may thereby facilitate cooling of the internal insert component 224 at any point during the casting process. Cooling directed at the internal insert component 224 in this manner may also facilitate targeted cooling of interior portion(s) of the part, e.g., along an interface between the molten material being solidified around the internal insert component 224, and the internal insert component 224 itself.

Figure 2:
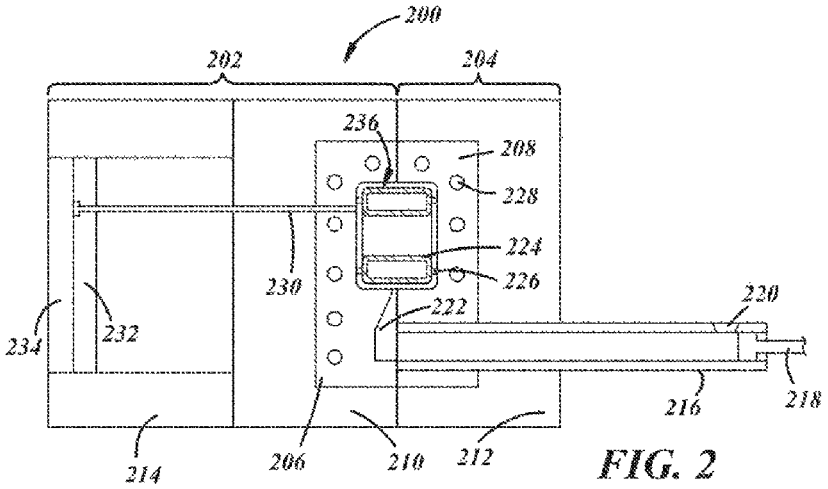
FIG. 2 is a front view of an example of a high pressure die casting fixture.

One or more ejector pin(s) 230 may be provided to facilitate removal of a formed composite part from the mold cavity 236. Although a single ejector pin 230 is illustrated in FIG. 2, any number of additional ejector pins 230 may be provided that is convenient. Ejector pin(s) 230 may be fixed at an end away from the mold cavity 236 to a movable ejector plate 232, which slides along a stationary support block 214. An ejector pin support plate 234 may also be provided, which may be fixed to the support block 214. The support plate 234 may facilitate movement of the slidable ejector plate 232 by providing a stationary reaction surface for the ejector plate 232.

Figure 3A:
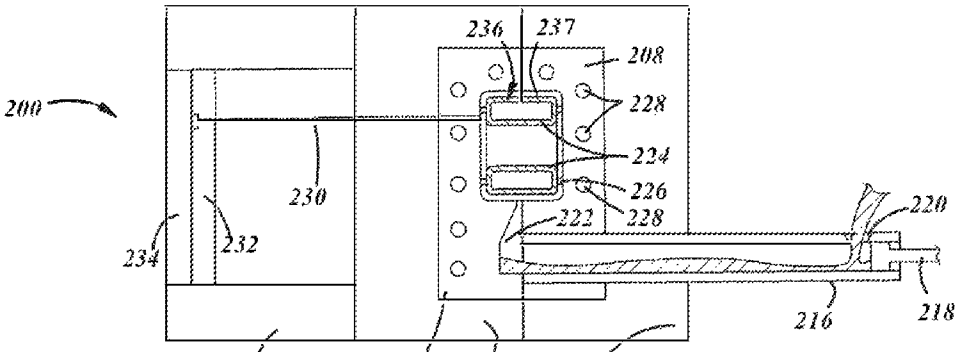
FIG. 3A is a front view of the casting die of FIG. 2, illustrating molten metal material being placed into a shot sleeve of the fixture.

Referring now to FIGS. 3A-3D, the operation of the tooling system 200 will be described in further detail. As shown in FIG. 3A, the internal insert component 224 may initially be positioned within the mold cavity 236. The internal insert component 224 may have at least a portion of an outer surface thereof that is formed with surface features configured to enhance bonding of the internal insert component 224 with a molten material subsequently injected into the mold cavity 236 and into contact with the outer surface of the internal insert component 224. In other examples, a shell or coating layer may be provided about at least a portion of the internal insert component 224; for example, a shell layer whose composition is identical or more similar to the external part material than the internal insert material. The mechanical surface features or material surface features (e.g., shell layer) are generally designed to enhance bonding between the materials of the internal insert component 224 and external part component 236. In some examples, particles may coat at least a portion of the surface of the internal insert component 224 in order to disperse or diffuse into an interface region between the internal insert component 224 and external part component 237 upon formation, and improve the overall material properties of the composite part 200.

The internal insert component 224 may be located within the mold cavity 236 using one or more locating pins 226, and a molten material may be poured into sleeve 216 through the pour hole 220. A variety of suitable molten materials may be employed. Merely by way of example, a titanium-based material may be used for the solid internal insert component 224, and an aluminum-based material such as an aluminum alloy may be used for the molten material of the external part component 237.

Figure 3B:
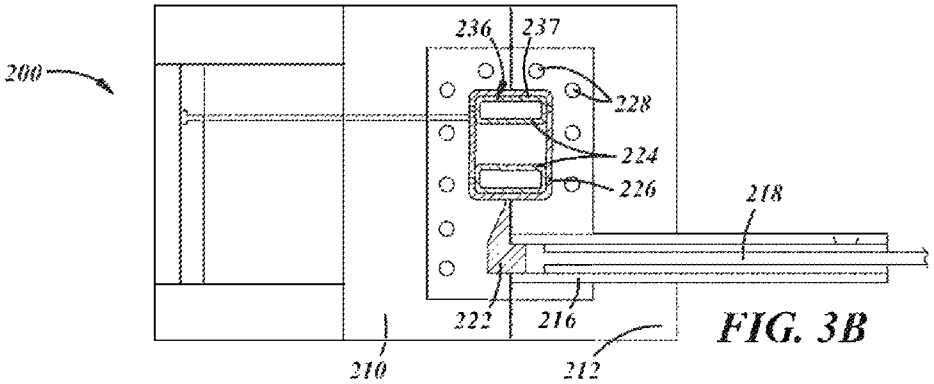
FIG. 3B is a front view of the casting die of FIG. 2, illustrating a plunger forcing the molten metal material through the shot sleeve.

Turning to FIG. 3B, the plunger 218 may be urged through the sleeve 216, thereby forcing the molten material out of the sleeve 216, through the runner 222, and into the mold cavity 236. In one example approach, the plunger 218 injects the molten material into the mold cavity 236 in a two-stage process where the plunger 218 initially moves in a first stage at a relatively slow first speed as the molten material is moved through the sleeve 216 and into the runner 222. In a second stage, the plunger 218 injects the molten material into the mold cavity 236 at increased pressure, which may be imparted to the molten material by an increase in speed and/or force of the plunger 218 as it moves through the sleeve 216.

Upon injection of the molten material into the mold cavity 236, the molten material may be cooled, e.g., by way of cooling channels 228. Additionally, the locating pins 226 may be disposed adjacent to one or more of the cooling channels 228, or be provided with features internal to the locating pin(s) 226 that facilitate cooling within the mold cavity 236. Moreover, cooling features of the locating pins 226 may facilitate cooling that is focused on the internal insert component 224, thereby allowing enhanced cooling of the composite part 200 from the inside of the part as it is formed.

Figure 3C:
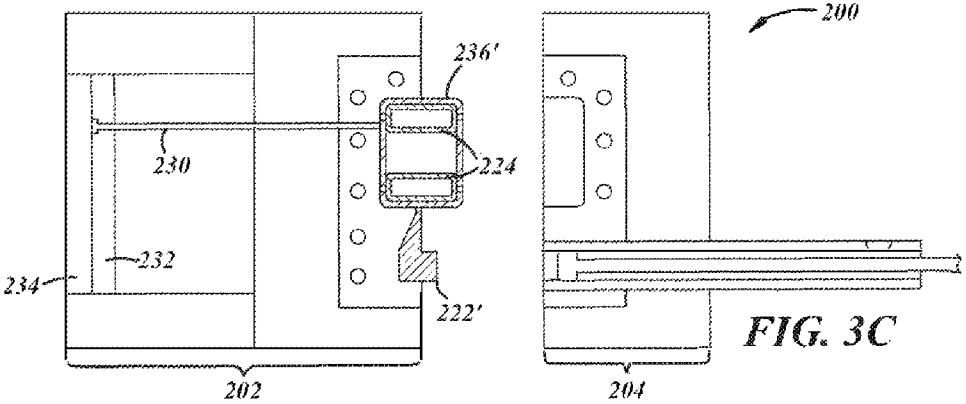
FIG. 3C is a front view of the casting die of FIG. 2, illustrating the die opening after a metallic part is solidified.
Figure 3D:
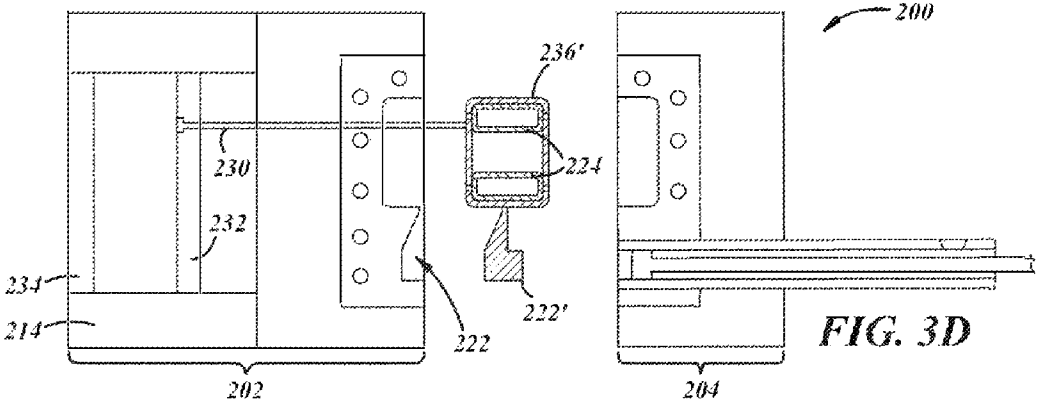
FIG. 3D is a front view of the casting die of FIG. 2, illustrating ejector pins forcing the metallic part out of the die.

Referring now to FIG. 3C, upon solidification of the molten material, the composite part 236' has been substantially formed from the internal insert component 224 and the solidified molten material surrounding at least a portion of the internal insert component 224. Additionally, a flashing 222' may have been formed during the solidification process, resulting from molten material which solidified within the runner 222. Once the molten material is solidified within the mold cavity 236, the movable ejector half 202 of the tool 200 may be moved away from the stationary half 204, exposing the solidified part 236'. The ejector pin(s) 230 may urge the solidified part out of the ejector half 202 of the tool, as seen in FIG. 3D. For example, the ejector plate 232 may slide laterally with respect to the support plate 234, thereby moving the ejected pin(s) 230 and forcing the composite part 236' out of the tool 200. The flashing 222' may be subsequently removed from the composite part 236' and recycled. Moreover, any additional finishing steps, e.g., machining, grinding, polishing, may be performed on the composite part 236' to remove additional flashing (not shown in FIG. 3D) or other portions of the composite part 236' that may be undesirable.

Figure 4A:
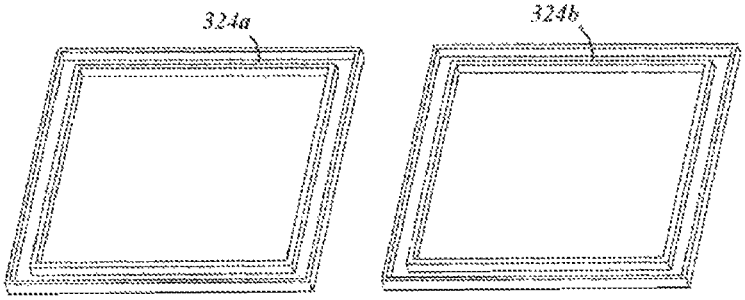
FIG. 4A is a perspective view of a two-piece internal insert component that is placed within a casting die, such as that illustrated in FIG. 2, where molten metal material can flow and solidify around the insert so that the insert becomes integrated within the composite part, according to one example.
Figure 4B:
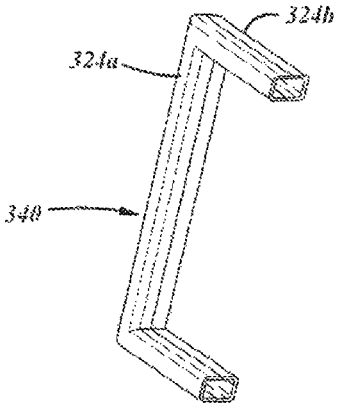
FIG. 4B is a perspective view of the internal insert component of FIG. 4A, shown assembled and partially sectioned.
Figure 4C:
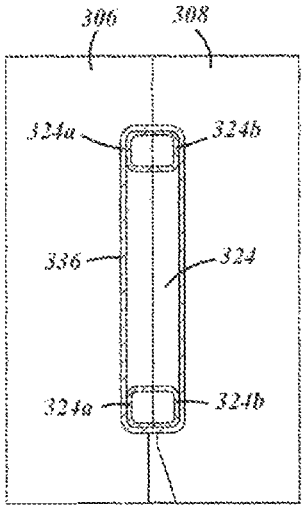
FIG. 4C is a section view of the internal insert component of FIGS. 4A and 4B, shown installed in a casting die such as that illustrated in FIG. 2.

Turning now to FIGS. 4A-4C, an exemplary internal insert component comprising separate halves 324*a*, 324*b* (collectively, internal insert component 324) is illustrated. The two halves 324*a*, 324*b* may be assembled together and placed within a mold cavity for forming a composite part 236' as described above. The internal insert 324 may also have at least a portion of an outer surface thereof prepared with surface features such as those described herein. The surface features may enhance bonding between an external part component 336 and the internal insert component 324. Additionally, surface applications with particles 340 may be provided on a portion of the internal insert 324, which may improve material properties and/or enhance bonding of the internal insert component 324 and the molten material used to form the external part component 336 of the composite part. While the internal insert component 324 of FIGS. 4A-4C is illustrated as being generally hollow and rectangular, in many other approaches a solid insert or inserts of other shapes may be employed. Hollow inserts will likely be favored in applications that are primarily focused on reducing the weight of the part (e.g., vehicle non-structural parts), whereas solid inserts will likely be favored in applications that are primarily focused on maintaining the strength of the part (e.g., vehicle structural parts like cross members, suspension components, control arms, engine cradles, connecting nodes, etc.).

The two halves 324*a*, 324*b* may initially be assembled together, as best seen in the perspective sectional view of FIG. 4B. Surface features may be formed on one or both halves 324*a*, 324*b* prior to or after assembly of the two halves 324*a*, 324*b*. Moreover, coating at least a portion of an outer surface of one or both halves 324*a*, 324*b* may occur prior to or after assembly of the two halves 324*a*, 324*b*. Once the internal insert component 324 is assembled and the surface features provided, the internal insert component 324 may be placed within a mold cavity defined by mold portions 306, 308 (see FIG. 4C). While the preceding description of the internal insert component 324 describes a two-piece insert, it is certainly possible for the insert to be a one-piece insert, to have more than two pieces, to be a solid insert, or to be provided according to some other embodiment.

Figure 5:
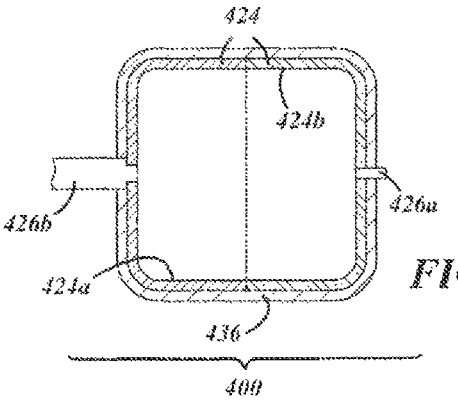
FIG. 5 is a lateral view of the internal insert component of FIGS. 4A-4C, shown installed in a casting die that includes several different examples of insert supports for holding the insert in place within the casting die.

In some examples, one or more locating pins may be used to position an internal insert component within a mold cavity. Example locating pins will now be described in further detail, referring to FIG. 5. In one example approach, a locating pin 426*a* may be cast-in to the external part component 436 so that it becomes part of the resulting composite part 400. The locating pin 426*a* may initially be cast into or pressed into an internal insert component 424 (comprising halves 424*a*, 424*b*, as shown in FIG. 5). As molten material introduced into the mold cavity cools, solidifying the molten material and permanently bonding to the internal insert component 424, the cast-in locating pin 426*a* may also become permanently bonded with the solidified external part component 436. Alternatively, as also shown in FIG. 5, a locating pin 426*b* may be permanently installed in the mold. Accordingly, the locating pin 426*b* does not become part of the resulting composite part 400.

As mentioned above, locating pin(s) used to position an internal insert component within a mold cavity may also facilitate cooling within the mold cavity. For example, locating pins may provide cooling of the molten material introduced to the cavity, the internal insert component, an interface region between the molten material and the internal insert component, or any combination/sub-combination of the three. In this manner, bonding of the molten material introduced to the mold cavity around the internal insert component may be enhanced by allowing enhanced control of temperatures within the mold cavity, especially in a boundary region between the internal insert component and the molten material of the external part component.

Surface Features

As mentioned above, a variety of different surface features may be applied to an outer surface of the internal insert component to help strengthen the bond or connection between that component and the external part component that is cast around it. Non-limiting examples of potential surface features include mechanical surface features, like texturing or scoring the surface of the internal insert so that it becomes non-smooth or rough, and material surface features, such as a thin shell or coating layer applied to the outside of the internal insert that affects the composition of an interface region formed between the internal and external components. Other examples of possible surface features exist. Moreover, as will be seen in some examples below, different types of surface features may be combined.

Figure 6B:
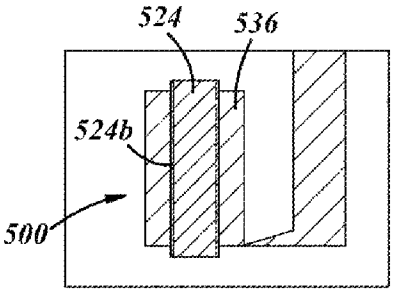
FIG. 6B is a section view of an example composite part in a high pressure die casting mold, where the internal insert component has a thin shell layer made of an aluminum-based material.
Figure 6A:
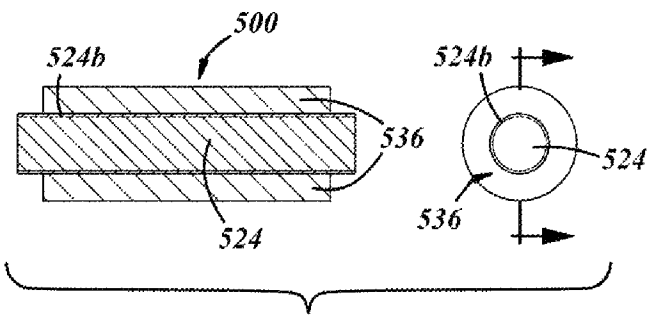
FIG. 6A is a section view of an example composite part where the internal insert component has a thin shell layer.

Turning now to FIGS. 6A-6B, there is shown an example of potential surface features in the form of a thin shell or coating layer that has been applied to at least a portion of the internal insert component 524. The composite part 500, as seen in FIG. 6A, may include an internal insert component 524 that is a generally cylindrical shape, and is surrounded by an external part component 536. In this particular example, the internal insert component 524 is a pre-fabricated, solid insert that is made from a titanium-based material, a shell layer 524*b* is a thin aluminized layer that is applied to the outside of the internal insert 524 and is made from an aluminum-based material, and the external part component 536 is a cast part that is formed around the internal insert and is made of an aluminum-based material with the same or different composition from that of the shell layer 524*b*.

The shell layer 524*b* may be applied over all or a portion of the outer surface of the internal insert component 524 in any number of suitable ways. In one example, the shell layer 524*b* is sprayed (e.g., via cold metal spraying) onto the surface of the titanium-based internal insert 524. In another example, the shell layer 524*b* is applied to a surface of the titanium-based internal insert 524 using electrodeposition techniques. Other techniques may be used as well. The shell layer 524*b* may be made from the same material as the external part component 536 or at least be more similar, in terms of composition, to the material of the external part component 536 than the internal insert component 524.

In one example illustrated in FIG. 6B, the internal insert component 524 may be provided with shell layer 524*b* and placed into a mold. Molten material may be injected into the mold, surrounding the internal insert 524, with the molten material solidifying to form the external part component 536 surrounding the internal insert 524. As described above, the shell layer 524*b* may enhance bonding between the internal insert component 524 and external part component 536, for example, by reducing gap formation between the two components or by providing a surface on the internal insert that is more metallurgically compatible and suitable for bonding with the material of the external part component 536 when it is in molten form. The preceding embodiments are examples of material surface features.

In some examples, different types of surface features of an internal insert component may be combined. Merely as one example, material surface features such as those described above with respect to FIGS. 6A and 6B may be combined with mechanical surface features. In one example approach, an outer surface of the insert 524 is initially provided with mechanical surface features, e.g., by way of laser ablation, chemical etching, or any other mechanical surface feature disclosed herein or otherwise convenient. The insert 524 may subsequently be provided with a material surface feature applied over the mechanical surface features. In one example described further below, a material surface feature is provided by way of an aluminum material applied in a casting or cold-spraying process to form shell layer 524*b* around at least a portion of the insert 524.

A combination of different types of surface features may generally improve bond strength between two different material types, and may in some cases create advantageous intermixing of different material types of the insert 524 and external part component 536. In one example of a combination of surface feature types, a mechanical surface feature is provided by way of a laser ablation or chemical etching process. A surface roughness of approximately 5-20 microns may be provided by the laser ablation or chemical etching.

Subsequently, a material surface feature may be provided overlaying the mechanical surface feature. In one example, a shell layer is cast or applied over the mechanical surface features of the internal insert component 524. In one example, a layer 524*b* of material formed by the material surface feature may be from several hundred microns to several millimeters in thickness (100 μm to 3 mm).

In examples where a material surface feature or shell layer is cast onto the mechanical surface features of the internal insert component, the internal insert component 524 may initially be placed into a die. The shell layer, e.g., an aluminum-based shell layer, may be cast around the internal insert component 524, and the temperature maintained at approximately 700 to 720 degrees Celsius for approximately 10-15 minutes. Subsequently, the internal insert component 524 including the shell layer may be cooled to room temperature. The pre-fabricated insert may subsequently be placed into a die, and the external part component 536 cast about the internal insert component 524 to form the completed part 500.

While the above example of casting a shell layer about the internal insert component 524 may be advantageous, in other examples, this intermediate casting step may be replaced with a cold metal spray process. In this example, aluminum particles may be deposited by a cold metal spraying process to the desired layer thickness, e.g., 1-3 millimeters.

Bonding between an internal insert component and an external part component may also be aided by preparation of the internal insert component 524 prior to application of material surface features. For example, the surface of the internal insert component 524 may be degreased, including any portion(s) of the internal insert component where the mechanical surface features are provided.

Figure 7:
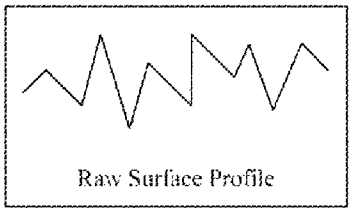
FIG. 7 is an illustration of a surface profile of a surface feature of an internal part component, according to an example illustration.

Turning now to FIGS. 7-10, there are shown several different examples of mechanical surface features that have been applied or formed on at least a portion of the outer surface of the internal insert component 524. In FIG. 7, a schematic illustration of a potential surface profile for an internal insert component is illustrated. The surface treatment generally creates an uneven, jagged, or otherwise irregular or undulating area on the surface of the internal insert component, which may enhance bonding between that component and the solidified material of the external part component through the creation of a mechanical interlock. Moreover, as noted above, the undulations or irregular surface profile may enhance the degree to which perpendicular reaction surfaces are provided with respect to part stresses, thereby enhancing an overall strength of a bond between an internal insert and external part component.

Figure 8:
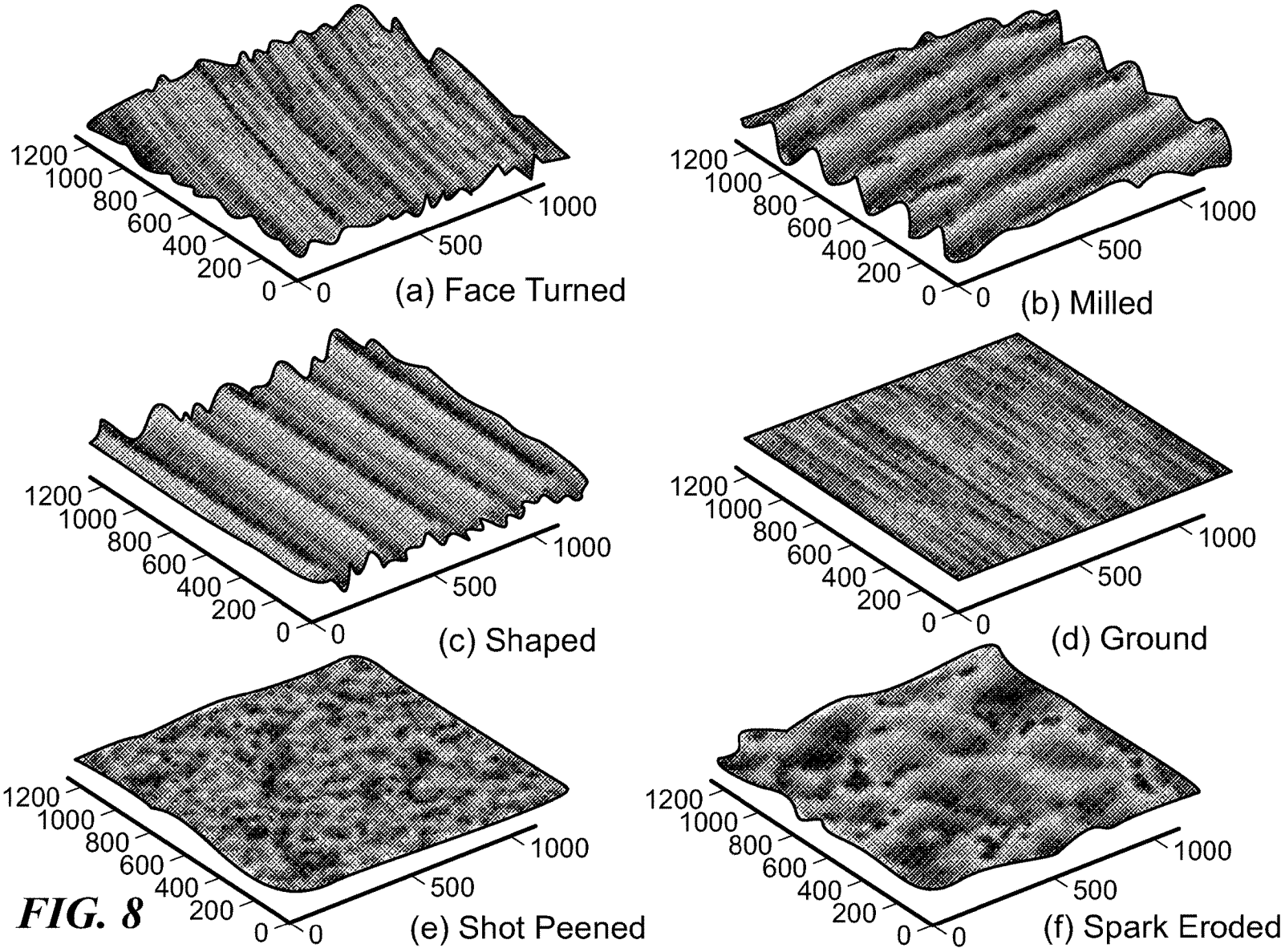
FIG. 8 is an illustration of six exemplary surface features for an internal part component.

Surface features may be formed on a surface of the internal insert component using a laser (e.g., a pulsed laser), such as by laser etching or ablating. Mechanical operations such as mechanical etching, abrasion, scoring, scratching, grinding, or sand blasting, or machining operations such as milling, turning, or vibro-mechanical texturing, may also be used to create the surface features, to cite a few possibilities. Additionally, other operations such as electrical discharge machining (EDM), plasma, or any other method that is suitable for forming surface discontinuities or undulations or otherwise roughing up the surface of the internal insert may be employed. As shown in FIG. 8, non-limiting examples of surface textures or patterns may include those formed using a face turning process (FIG. 8(*a*)), milling (FIG. 8(*b*)), shaping (FIG. 8(*c*)), grinding (FIG. 8(*d*)), shot peening (FIG. 8(*e*)), and spark erosion (FIG. 8(*f*)), each of which may provide increased surface area in the interface region between the internal and external components.

Figure 9A:
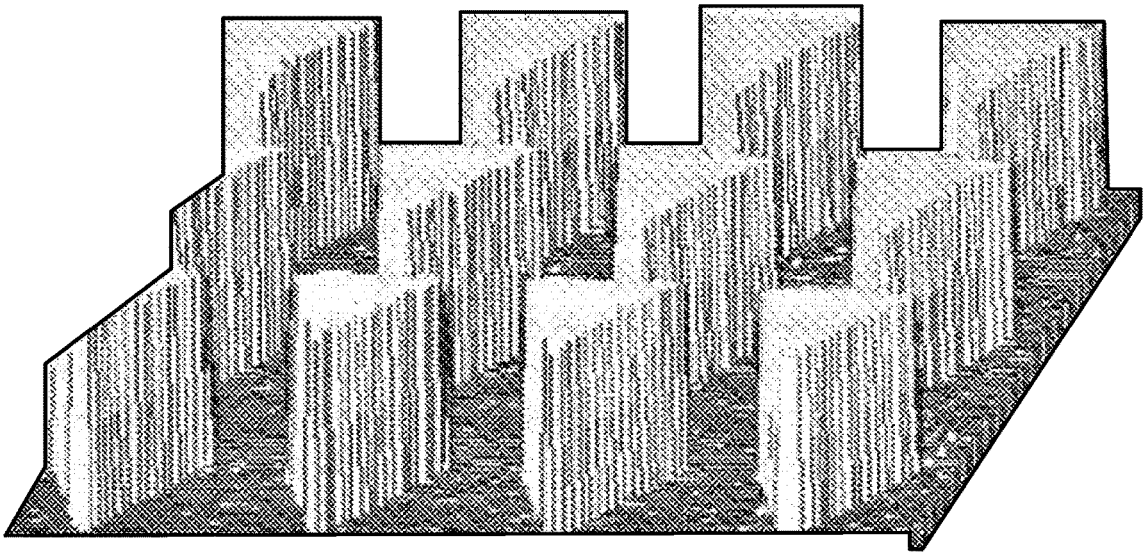
FIG. 9A is an illustration of an exemplary surface feature for an internal part component, where the surface texture is structured or deterministic.
Figure 9B:
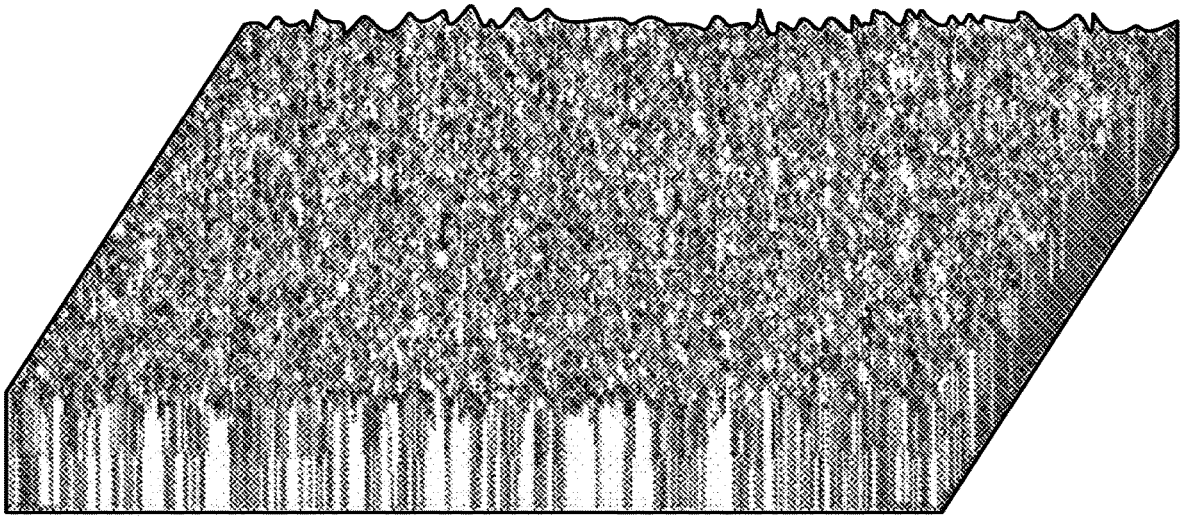
FIG. 9B is an illustration of an exemplary surface feature for an internal part component, where the surface texture is random.
Figure 10:
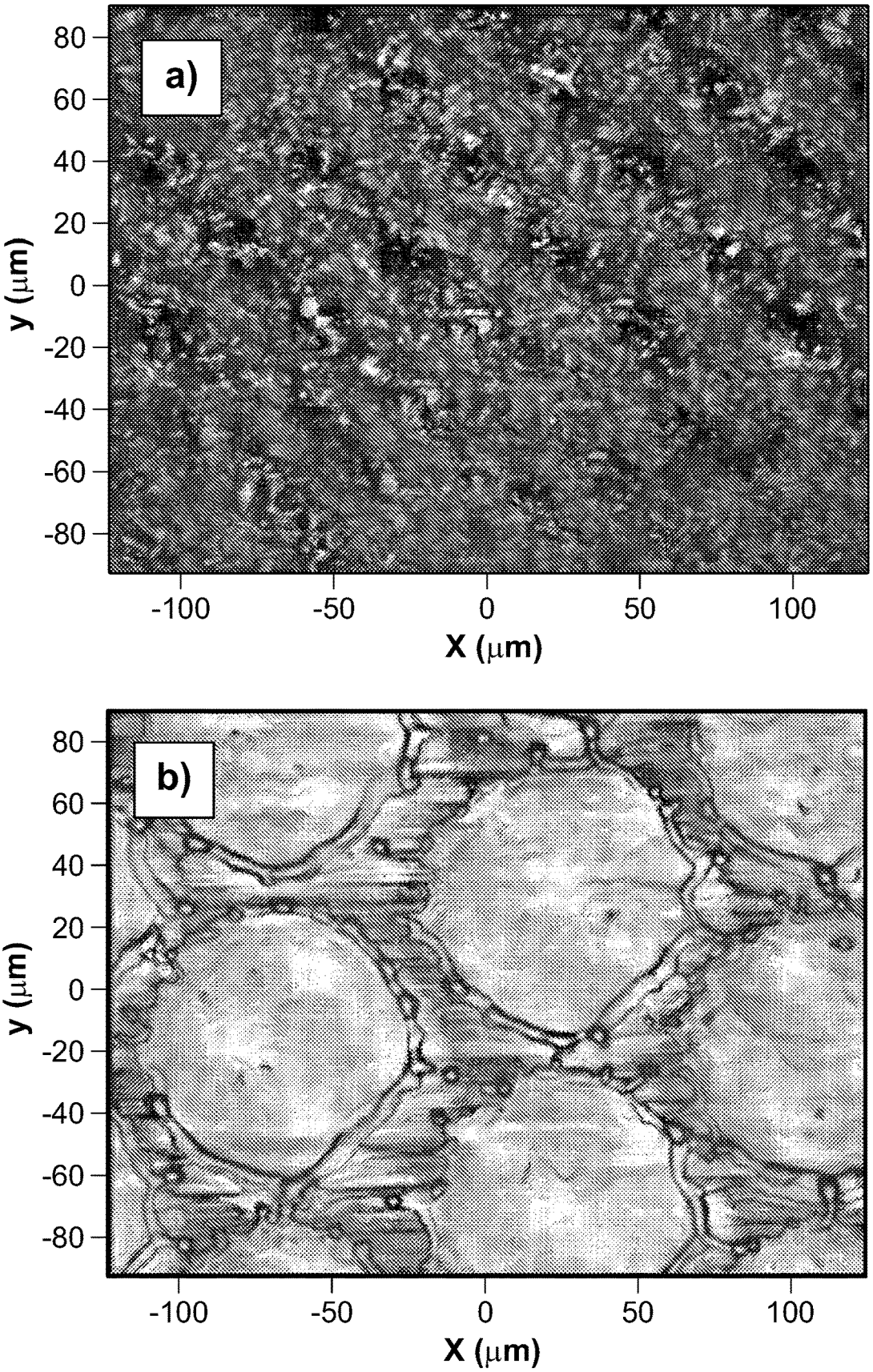
FIGS. 10A and 10B illustrate an enlarged view of a surface treatment, according to an exemplary approach.

Some surface treatments may provide a structured or deterministic texture, e.g., as illustrated in FIG. 9A. A structured or deterministic texture may result from processes that are capable of forming a regular texture or pattern on a generally microscopic level, e.g., laser ablation. Alternatively, a surface texture may have a random texture, i.e., an irregular or non-recurring pattern, as illustrated in FIG. 9B. Such irregular patterns or textures may result from mechanical material removal processes such as grinding, scoring, scratching, etching processes, sand blasting or any other material removal process that acts in a generally random manner, or is capable of being applied in a random manner, with respect to the surface of the internal insert component at a microscopic level.

As noted above, laser surface treatments may be used to create a desired surface texture or roughness. Turning now to FIGS. 10A and 10B, exemplary surface treatments created on a titanium-based insert using a laser are shown. In FIG. 10A, a micrograph shows textured surface features on a portion of an internal insert that were formed with the use of a laser having 25 μm pulse separation. By comparison, FIG. 10B shows a surface topography of a similar sample that was formed with a laser having 100 μm pulse separation. In both cases, the laser was operated with 0.71 mJ pulses at 200 kHz repetition frequency. A higher pulse separation such as that shown in FIG. 10B, may result in a more regular, hexagonal pattern or structure that is clearly visible, reducing the number of asperities available for possible interlocking. By contrast, the surface in FIG. 10A appears relatively random, and contains a significant number of spherical asperities. Accordingly, a lower pulse separation such as that shown in FIG. 10A may be employed where there is a need for increased randomness of surface features, while a higher pulse separation such as that shown in FIG. 10B may be employed if a more regular or patterned surface texture is desired.

In the examples directed to formation of surface textures, the surface treatments may include both creating a desired surface texture or roughness (e.g., by mechanical abrasion, chemical etching, laser ablation, etc.), and also a degreasing of the surface of the internal insert component. The degreasing of the surface may generally remove contaminants, oxidation, or any other foreign matter that might otherwise become entrained in the resulting composite part, thereby improving bonding between the internal insert component and external part component.

It should be noted that material surface features and mechanical surface features are not mutually exclusive, as the internal insert component could have both types of surface features for improved bonding. For instance, it is possible to provide a titanium-based internal insert component where at least a portion of its outer surface is provided with both a textured surface (e.g., those produced using lasers) as well as a thin shell layer (e.g., one made up of an aluminum-based material). In other embodiments, it is possible for a first section of the internal insert outer surface to be covered with mechanical surface features and a second section of the internal insert outer surface to be covered with a thin layer of material surface features. The location and coverage of such surface features can be strategically selected, such as in areas of the insert component having tight radii, turns, bends, etc. that can make it difficult to bond with the part component. Moreover, as noted above, in some examples material surface features and mechanical surface features may each be provided in at least a portion of an internal insert component; that is, mechanical surface features in some areas and material surface features in others, perhaps with some combined overlapping areas.

Figure 12:
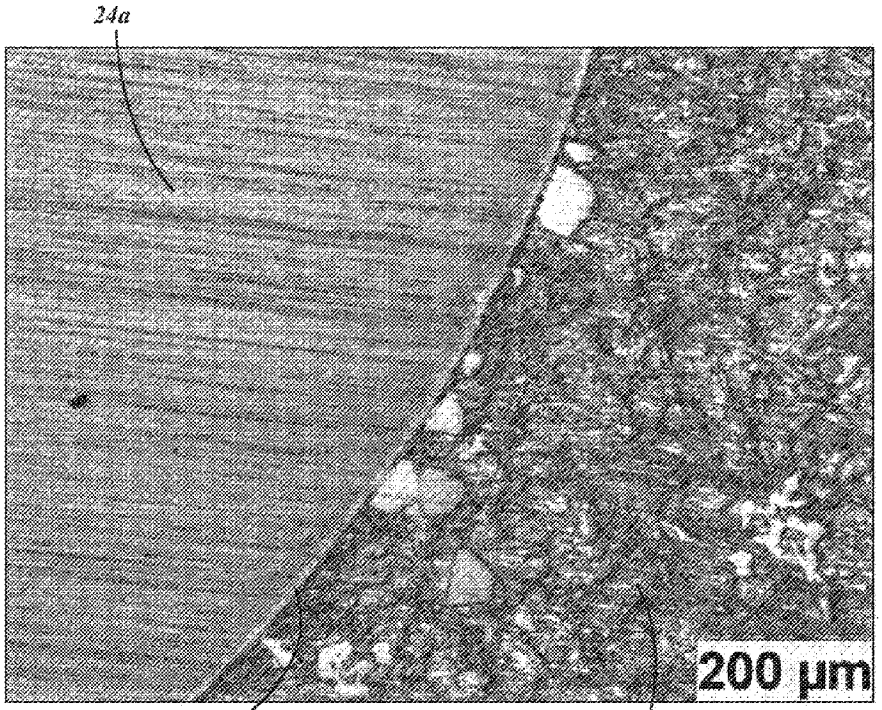
FIG. 12 is an enlarged view of a cross-section of an interface region between a rod-shaped internal insert component formed of a titanium-based material, and an external part component formed of an aluminum-based material.

Turning now to FIGS. 12-14, example interface regions formed using various approaches discussed above are illustrated and described in further detail.

In one example shown in FIG. 12, an interface region 40*a* is formed between a rod-shaped internal insert component 24*a*, which is formed of a titanium material, and an external part component 36*a*, which is formed of an aluminum material. Another example is shown in FIGS. 13A and 13B, which illustrate another example interface region 40*b* at different magnifications. Interface region 40*b* may be formed between a tubular internal insert component 24*b* and an external part component 36*b*.

As noted above, the interface regions 40*a*, 40*b* may have an increased thickness relative to previous approaches. For example, the interface regions 40*a*, 40*b* may comprise titanium aluminide (TiAl) or other intermetallics of aluminum and titanium (for example, $Al_3Ti$). The interface regions in these examples are between 1 μm and 10 μm thick, inclusive.

Turning now to FIGS. 14A-14B a cold-sprayed shell layer or coating 36*c* formed of an aluminum-based material is illustrated about an internal insert component 24*c*, which is formed of a stainless steel material. A cold spraying process, according to one example, is performed at a relatively high speed, in some cases exceeding the speed of sound. Accordingly, a greater penetration and/or coating of the internal insert component 24*c* is achieved compared with materials cast about an internal insert component. Example cold-sprayed layers may be between approximately 1-3 mm thick, inclusive. Stainless steel inserts, particularly those having a hollow or tubular shape, may be employed as a fluid passage channel for a part. The stainless steel insert may thereby facilitate cooling and/or lubrication of the external part component by way of the passage(s).

Method of Producing Composite Part

Figure 11:
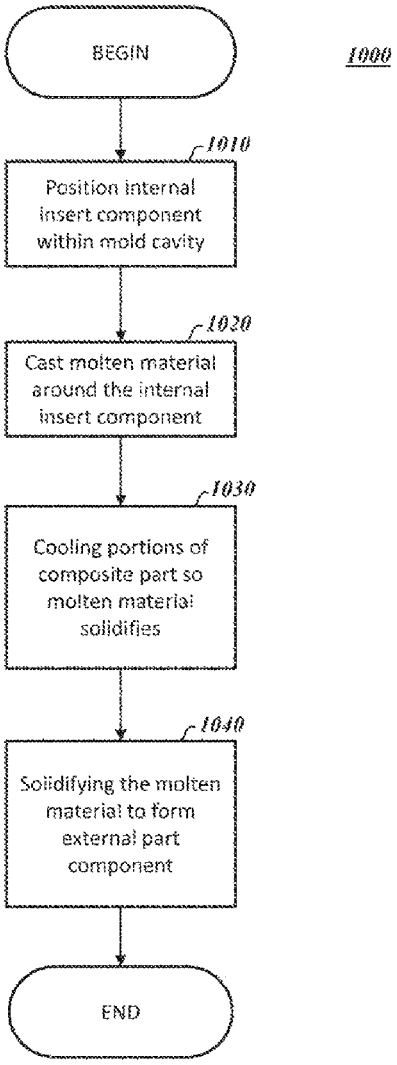
FIG. 11 is a process flow diagram for a method of forming a composite part where an external part component is cast and solidifies around an internal insert component during a die casting process, according to one example.

Turning now to FIG. 11, an example process 1000 is illustrated for forming a composite part having an internal insert component and an external part component. Process 1000 may begin at block 1010, where an internal insert component is positioned in a mold cavity. For example, an internal insert component 224, 324, 424, or 524 may be positioned within a mold of a casting die. While the internal insert component may be formed of any material that is suitable, example materials include titanium-based alloys and other materials. The internal insert component in step 1010 may or may not already have one or more surface features applied to its outer surface. As already explained, the internal insert component may include any suitable combination of mechanical surface features (e.g., laser- or machine-generated etchings, texturing, grooves, etc.), material surface features (e.g., a thin shell or coating layer comprised of an aluminum-based material) and/or other types of surface features. Additionally, in some examples, the internal insert component may be provided with a coating on at least a portion of an outer surface, in order to facilitate the formation of a particle-rich region. The surface features may be applied to the internal insert component outer surface before the insert is positioned in the mold cavity (i.e., a pre-manufactured insert) or after positioning within the mold cavity. Moreover, as discussed above, different types of surface features may be employed together.

At block 1020, a molten material is introduced to the mold cavity and cast around the internal insert component. For example, this step may utilize the equipment and follow the process outlined above in connection with FIGS. 2-3D, where a molten aluminum-based material is introduced into a mold cavity where the internal insert component is already positioned and held in place by one or more locator pins. Any number of different casting processes may be used including, but not limited to, gravity casting, low pressure casting and high pressure die casting. According to some embodiments, high pressure die casting of aluminum-based alloys is preferred.

Proceeding to block 1030, one or more portions of the composite part are cooled so that the molten material of the external part component solidifies and hardens around the internal insert component. Cooling may be facilitated, for example, using internal cooling channels 228 in the mold cavity, using self-cooling locating or support pins 226, 426 and/or using some other type of cooling features, as described above. Consistent with the examples provided, self-cooling locating pins 226, 426*a*, 426*b* may utilize a phase-change material and solid pins to conduct heat away from the molten material, or liquid cooling channels within hollow pins to remove the heat. In those instances where cooling channels 228 in the mold cavity are used, the molten material is generally cooled from the outside in; whereas, the use of self-cooling pins in contact with the internal insert component facilitates cooling the molten material from the inside out. Process 1000 may then proceed to block 1040.

At block 1040, the molten material is solidified to form an external part component around the internal insert component and, thus, complete the composite part. As already explained, the surface features of the internal insert component may generally enhance a bond strength, in terms of mechanical, metallurgical and/or both, between the two components. Moreover, as described above, in some approaches a particle-rich region may be formed between the internal insert component and external part component, e.g., by a dispersion of particles that were initially applied in a coating to a portion of the internal insert component, as described above.

It is to be understood that the foregoing description is not a definition of the invention, but is a description of one or more exemplary illustrations of the invention. The invention is not limited to the particular example(s) disclosed herein, but rather is defined solely by the claims below. Furthermore, the statements contained in the foregoing description relate to particular exemplary illustrations and are not to be construed as limitations on the scope of the invention or on the definition of terms used in the claims, except where a term or phrase is expressly defined above. Various other examples and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A method of forming a composite part having an internal insert component and an external part component, the method comprising:

positioning the internal insert component within a mold cavity, the internal insert component formed of a first material that includes a titanium-based material, wherein at least a portion of an outer surface of the internal insert component includes mechanical surface features that define a plurality of depressions in the outer surface of the internal insert component, the mechanical surface features have an average depth of 5 μm-100 μm, inclusive, and the mechanical surface features present an irregular surface contour;

casting a molten second material around the internal insert component along the irregular surface contour of the internal insert component, the second material is different from the first material and includes an aluminum-based material; and solidifying the molten material to form the external part component, the mechanical surface features help establish a bond within the composite part between the internal insert component and the external part component;

wherein the bond between the internal insert component and the external part component includes both a mechanical interlock formed between the solidified molten material and the mechanical surface features and a metallurgical interface formed between the different materials of the internal insert component and the external part component, and the metallurgical interface includes an interface region having aluminum-titanium compounds.

2. The method of claim 1, wherein the internal insert component is made of the titanium-based material and the external part component is made of the aluminum-based material.

3. The method of claim 2, wherein the internal insert component is a prefabricated insert that is made of the titanium-based material so as to strengthen the composite part.

4. The method of claim 2, wherein the external part component is a high pressure die cast part that is made of the aluminum-based material so as to be lightweight.

5. The method of claim 1, wherein the casting and solidifying steps are part of a high pressure die casting process.

6. The method of claim 1, further comprising the step of: forming the surface features on the outer surface of the internal insert component before positioning the internal insert component within the mold cavity, wherein the forming step uses at least one of the following techniques: laser ablating, laser etching, laser scoring, mechanical machining, wire brushing, chemical texturing, electrical discharge machining (EDM), plasma treating and/or sand blasting.

7. The method of claim 1, further comprising the step of: forming a shell or coating layer over top of at least a portion of the outer surface of the internal insert component so that the shell or coating layer covers at least some of the mechanical surface features and fills in at least some of the plurality of depressions in the outer surface, the shell or coating layer includes a material that has the same or similar composition as that of the external part component.

8. The method of claim 7, wherein the shell or coating layer is formed in a casting process, including maintaining a mold temperature of at least 700 degrees Celsius for at least 10 minutes, and subsequently cooling the internal insert component after the shell or coating layer is applied to the internal insert component.

9. The method of claim 7, wherein the shell or coating layer is formed with a thickness of approximately 1-3 millimeters overlying mechanical surface features having a surface roughness of between 5 μm-20 μm, inclusive.

10. The method of claim 7, wherein the shell or coating layer is comprised of a plurality of particles.

11. The method of claim 10, wherein the plurality of particles have an average diameter that is less than or equal to about 100 μm.

12. The method of claim 10, wherein the plurality of particles have an average diameter that is greater than or equal to about 25 mm to less than or equal to about 100 mm.

13. The method of claim 10, further comprising the step of: forming the surface features on the outer surface of the internal insert component before positioning the internal insert component within the mold cavity, wherein the forming step uses at least one of the following techniques: hot fusion, cold spraying, high velocity spraying, electrodeposition.

14. The method of claim 10, further comprising the step of: forming the surface features on the outer surface of the internal insert component during the process of casting or otherwise forming the insert itself.

15. The method of claim 1, wherein the plurality of depressions of the mechanical surface features define undulations in the outer surface of the internal insert component.

16. The method of claim 1, wherein the plurality of depressions of the mechanical surface features define an irregular and non-reoccurring pattern in the outer surface of the internal insert component.

17. The method of claim 16, wherein the irregular and non-reoccurring pattern is formed by a laser ablation technique using a low frequency laser pulse separation.

18. The method of claim 1, wherein the plurality of depressions of the mechanical surface features define a regular and patterned surface texture in the outer surface of the internal insert component.

19. The method of claim 18, wherein the regular and patterned surface texture is formed by a laser ablation technique using a high frequency laser pulse separation.

* * * * *